US006236300B1

(12) United States Patent
Minners

(10) Patent No.: US 6,236,300 B1
(45) Date of Patent: May 22, 2001

(54) BISTABLE MICRO-SWITCH AND METHOD OF MANUFACTURING THE SAME

(76) Inventor: R. Sjhon Minners, 1154 Lennon Way, San Jose, CA (US) 95125

( * ) Notice: Subject to any disclaimer, the term of this patent is extended or adjusted under 35 U.S.C. 154(b) by 0 days.

(21) Appl. No.: 09/277,330

(22) Filed: Mar. 26, 1999

(51) Int. Cl.[7] ..... H01H 37/46; H01H 37/48

(52) U.S. Cl. ..... 337/139; 337/140; 148/402

(58) Field of Search ..... 337/14, 12, 139, 337/140, 141, 339, 343, 393, 298; 439/161, 267, 325, 630, 932; 148/402, 563; 60/527, 528

(56) References Cited

U.S. PATENT DOCUMENTS

| | | | | |
|---|---|---|---|---|
| 3,753,792 | * | 8/1973 | Tyler | 148/13 |
| 4,411,711 | * | 10/1983 | Albrecht et al. | 148/11.5 A |
| 4,423,401 | * | 12/1983 | Mueller | 337/107 |
| 4,544,988 | | 10/1985 | Hochstein . | |
| 4,551,974 | * | 11/1985 | Yaeger et al. | 60/527 |
| 4,570,139 | | 2/1986 | Kroll | 335/187 |
| 4,585,209 | * | 4/1986 | Aine et al. | 251/129.02 |
| 4,797,649 | | 1/1989 | Homma . | |
| 4,806,815 | * | 2/1989 | Honma | 310/307 |
| 4,823,105 | * | 4/1989 | Givler | 337/368 |
| 4,864,824 | | 9/1989 | Gabriel et al. . | |
| 4,887,430 | | 12/1989 | Kroll et al. | 60/527 |
| 5,061,914 | | 10/1991 | Busch et al. . | |
| 5,258,591 | | 11/1993 | Buck . | |
| 5,325,880 | * | 7/1994 | Johnson et al. | 137/1 |
| 5,367,136 | | 11/1994 | Buck . | |
| 5,402,099 | * | 3/1995 | Ballard et al. | 337/298 |
| 5,405,337 | * | 4/1995 | Maynard | 604/281 |

(List continued on next page.)

FOREIGN PATENT DOCUMENTS

| | | |
|---|---|---|
| 42 05 029 C1 | 2/1993 | (DE) . |
| 0 923 099 A1 | 6/1999 | (EP) . |
| 2225828 | 11/1974 | (FR) . |
| WO 98/09312 | 3/1998 | (WO) . |
| WO 98/19320 | 5/1998 | (WO) . |
| WO 98/33195 | 7/1998 | (WO) . |

OTHER PUBLICATIONS

H. Hyman and M. Mehregany, "Contact Physics of Gold Microcontacts for MEMS Switches," Transactions on Components and Packing Technology, vol. 22, No. 3, Sep. 15, 1999.

L. Holland and E. Peterson, "Bottom Contact Micromechanical Switching Geometry," IBM Technical Disclosure Bulletin, vol. 21, No. 3, p. 1207–1208 (1978).

J. Yao and F. Chang, "A Surface Micromachines Miniature Switch for Telecommunications Applications with Signal Frequencies from DC Up to 4 GHZ," International Conference on Solid–State Sensors and Actuators and Eurosensors IX, vol. 2, p. 384–387 (1995).

K.E. Petersen, Micromechanical Membrane Switches on Silicon, IBM Journal of Research and Development,. vol. 23, No. 4, Jul. 1979.

*Primary Examiner*—Gerald Tolin
*Assistant Examiner*—Anatoly Vortman
(74) *Attorney, Agent, or Firm*—Howrey Simon Arnold & White, LLP

(57) ABSTRACT

The present invention provides a bistable switch using a shape memory alloy, and a method for manufacturing the same. More specifically, the bistable switch includes a substrate having at least one power source; a flexible sheet having a first distal end attached to the substrate; a bridge contact formed at a second and opposite distal end of the flexible sheet; and at least one heat activated element connected to a first surface of the flexible sheet and between the second distal end and the power source. During operation, current from the power source passing through the heat activated element to indirectly bend the flexible sheet and short the signal contacts on the substrate with a sustainable force.

6 Claims, 5 Drawing Sheets

U.S. PATENT DOCUMENTS

| | | | | |
|---|---|---|---|---|
| 5,410,290 | | 4/1995 | Cho . | |
| 5,440,193 | * | 8/1995 | Barrett | 340/328 |
| 5,535,815 | | 7/1996 | Hyman . | |
| 5,619,177 | | 4/1997 | Johnson et al. | 337/140 |
| 5,656,986 | | 8/1997 | Sassone et al. . | |
| 5,669,977 | | 9/1997 | Shufflebotham et al. . | |
| 5,684,448 | | 11/1997 | Jacobsen et al. . | |
| 5,763,979 | | 6/1998 | Mukherjee et al. . | |
| 5,769,159 | | 6/1998 | Yun . | |
| 5,825,275 | * | 10/1998 | Wuttig et al. | 337/139 |
| 5,870,007 | * | 2/1999 | Carr et al. | 333/262 |
| 5,977,858 | | 11/1999 | Morgen et al. | 337/140 |

* cited by examiner

BISTABLE MICRO-SWITCH AND METHOD OF MANUFACTURING THE SAME

BACKGROUND OF THE INVENTION

1. Field of the Invention

This invention relates in general to micro-switches and, more particularly, to a micro-machined bistable switch using a shape memory alloy.

2. Description of the Related Art

The first electro-mechanical and solid state micro-switches were developed in the late 1940's. Since that time, the electronics industry has pushed the manufacturing and functional limits for producing such switches. In particular, current electro-mechanical micro-switches exhibit technical inadequacies in size, cost function, durability, and connection techniques for high frequency applications. In turn, solid state switches exhibit a characteristically high off-state to on-state impedance ratio, and for many applications, undesirably high values of on-state "contact" resistance in off-state coupling capacitance. Consequently, the electronics industry is currently looking into new and innovative ways to manufacture switches that can be smaller, more reliable, durable, functional, and cost efficient.

In a variety of present day and predicted circuit applications, a need exists for low cost, micro-miniature switching devices that can be fabricated on conventional hybrid circuit substrates or boards and have bistable capabilities. In addition, the manufacturing process for these devices should be compatible with conventional solid state techniques such as thin-film deposition and patterning procedures used to form the conductive paths, contact pads and passive circuit elements included in such circuits.

A shape memory alloy ("SMA") is a known material capable of undergoing plastic deformation from a "deformed" shape to a "memory" shape when heated. If the SMA material is then allowed to cool, it will return partially to its deformed shape and can be fully returned to the deformed shape. In other words, the SMA material undergoes a reversible transformation from an austenitic state to a martensitic state with a change in temperature.

Research and development companies have only touched the surface of how this controllable shape deformation material can be used in switching structures. For example, conventional electro-mechanical switches have used SMA wires as a rotary actuator and bent SMA sheets as a valve. The wire is twisted or torsioned about its longitudinal axis and the ends of the wire are then constrained against movement. The sheet actuators are mechanically coupled to one or more movable elements such that the temperature-induced deformation of the actuators exerts a force or generates a motion of the mechanical elements.

The problems with these and similar SMA switch configurations and manufacturing techniques are similar to those described above for conventional electro-mechanical switches. In particular, constraints of size, reliability, durability, functionality, and cost limit the usefulness of prior art SMA switches.

In closing, conventional switches and relays, with or without the use of shape memory alloys, are normally large, bulky, or too fragile to be used for industrial purposes or mass production. Therefore, it would be advantageous to develop a switch or relay that can benefit from the characteristics of a shape memory alloy and eliminate the problems listed above of current switching technologies that may or may not use a shape memory alloy.

The present invention is directed to overcoming, or at least reducing the effects of, one or more of the problems set forth above.

SUMMARY OF THE INVENTION

In one embodiment, the present invention provides a bistable switch. The switch includes the following elements: a substrate having at least one power source; a flexible sheet having a first distal end attached to the substrate; a bridge contact formed at a second and opposite distal end of the flexible sheet; and at least one heat activated element connected to a first surface of the flexible sheet and between the second distal end and the power source, wherein current from the power source passing through the heat activated element indirectly bends the flexible sheet and shorts the signal contacts on the substrate with a sustainable force.

Another embodiment of the present invention provides a process for manufacturing a bistable switch for a substrate having signal line contacts and a power source. In particular, the process comprises providing a flexible sheet; connecting at least one heat activated element between a first distal end of the flexible sheet and the power source; forming a conductive bridge contact at the first distal end of the flexible sheet; and mounting a second and opposite distal end of the flexible sheet to the substrate, wherein current from the power source passing through the heat activated element indirectly bends the flexible sheet and shorts the signal contacts on the substrate.

The inventive structure provides a relatively simple and inexpensive way to produce bistable switches with performance levels not attainable with current solid state approaches using the standard semiconductor base unit, the transistor. This new and innovative micro-machine way of fabricating micro-switches will enable the users to build systems that can carry very high voltage, current, and frequency signals. This becomes possible since the micro-switch is conceptually equivalent to a micro-relay. In fact, this micro-switch is a mechanical micro-structure that moves to connect or disconnect conductive contacts. In addition, this design and method is compatible with standard silicon processing, allowing mass production at a reasonable cost.

BRIEF DESCRIPTION OF THE DRAWINGS

Other aspects and advantages of the invention will become apparent upon reading the following detailed description and upon reference to the drawings, in which:

FIGS. 3A and 3B–5A and 5B illustrate a process for manufacturing the bistable switch of FIG. 1;

Figure 1:
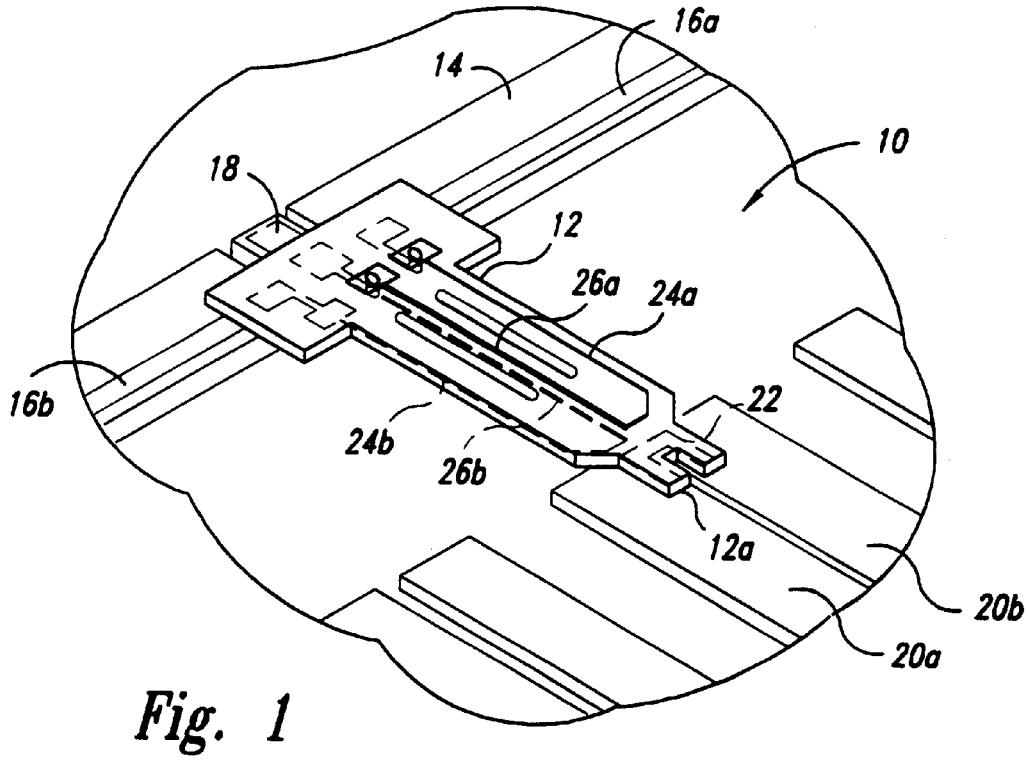
FIG. 1 illustrates a perspective view of a bistable switch in accordance with one embodiment of the present invention.

While the invention is amenable to various modifications in alternative forms, specific embodiments thereof have been shown by way of example in the drawings and are herein described in detail. It should be understood, however, the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

The present invention employs the unique properties of a shape memory alloy ("SMA") with recent advances in micro-machining to develop an efficient, effective and highly reliable micro-switch. The use of an SMA in micro-switches increases the performance of switches or relays by several orders of magnitude. In particular, this is accomplished because both stress and strain of the shape memory effect can be very large, providing substantial work output per unit volume. Therefore, micro-mechanical switches using SMA as the actuation mechanism can exert stresses of hundreds of megapascals; tolerate strains of more than three percent; work at common TTL voltages that are much lower than electrostatic or PZO requirements; be directly powered with electrical leads on a chip; and survive millions of cycles without fatigue.

Shape memory alloys undergo a temperature related phase change beginning at temperatures above $T_A$, which can be characterized by the ability of the alloy to recover any initial shape upon heating of the alloy above a temperature $T_A$ and below $T_H$, regardless of mechanical deformation imposed on the alloy at temperature below $T_A$. In operation, when the SMA material is at a temperature $T_L$, below temperature $T_A$, the SMA possesses a particular crystal structure whereby the material is ductile and may be deformed into an arbitrary shape with relative ease. Upon heating the SMA to a temperature $T_H$, above temperature $T_A$, the crystal structure changes in order to restore the SMA back to an initial, undeformed shape, to resume the originally imparted shape, thereby representing the onset of a restoring stress. Consequently, the transition temperature range of a shape memory alloy, over which the phase transformation occurs, is defined as being between $T_H$ and $T_A$. The SMA is optimally deformed between 2 and 8% at temperatures below $T_A$ which deformation can be fully recovered upon heating of the SMA to between $T_A$ and $T_H$. One preferred deformation is 4%.

These memory materials have been produced in bulk form primarily in the shape of wires, rods, and plates. The most conventional and readily available shape memory alloy is Nitinol, an alloy of nickel and titanium. However, other SMAs include copper-zinc-aluminum, or copper-aluminum-nickel. With a temperature change of as little as 18° C., Nitinol can go through its phase transformation and exert a very large force when exerted against a resistance to changing its shape. As discussed earlier, conventional switches and relays that use shape memory alloys generally operate on the principle of deforming the shape memory alloy while it is below phase transformation temperature range. Heating the deformed alloy above its transformation temperature range recovers all or part of the deformation, and the motion of the alloy moves the necessary mechanical elements.

Turning now to the drawings, FIG. 1 illustrates a thermally-actuated bistable micro-mechanical switch 10 in accordance with one embodiment of the present invention. Actuating arm 12 of switch 10 is micro-machined and secured to an upper substrate surface 14. Substrate 14 could include an insulated silicon or gallium-arsonide substrate, a printed circuit board, a flat plate of a ceramic material such as high density alumina ($Al_2O_3$) or beryllia (BeO), or a glassy material such as fused silica. However, persons of ordinary skill in the relevant arts should appreciate that the present inventive switch is not so limited, and therefore can be mounted to nearly any stable structure to provide the desired cantilever style bistable switch.

Upper surface 14 provides control contacts 16*a,* 16*b* and ground contact 18 to securely interconnect the respective control and ground contacts of arm 12. In addition, upper substrate surface 14 provides signal contacts 20*a* and 20*b* to be bridged or shorted by conductive bridge contact 22 of arm 12. Signal contacts 20*a* and 20*b* may carry or support any electrical signal, including, for example, conventional analog or digital data, or voice signals.

Top and bottom conductive path elements 24*a* and 24*b* couple to arm 12 by a conventional technique, and the two SMA elements 26*a* and 26*b* mount between the contact and ground vias on the top and bottom center beam of arm 12. In one embodiment, SMA elements 26*a* and 26*b* are made from a wire of a titanium nickel alloy having a diameter of between about 25 and 125 microns.

Figure 2:
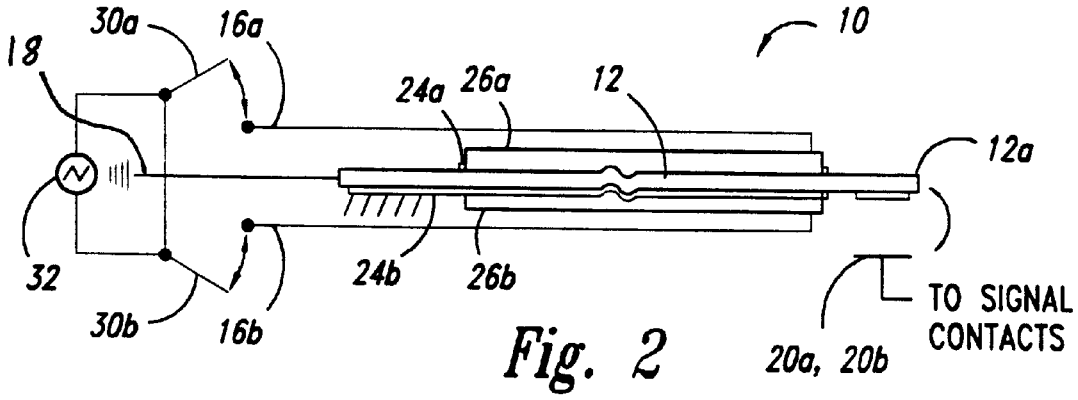
FIG. 2 illustrates a general schematic layout of the inventive bistable switch of FIG. 1.

During operation the above inventive switch provides the basic circuit structure as illustrated in FIG. 2. In particular, when relay 30*a* is closed and relay 30*b* is open, current passing through the top conductive horseshoe-type path, composed of elements 16*a,* 24*a,* 26*a,* and 18, will move arm 12 upward. In contrast, when relay 30*a* is open and relay 30*b* is closed, current passing through the bottom conductive horseshoe-type path, composed of elements 16*b,* 24*b,* 26*b,* and 18, will move arm 12 downward. The force present during the thermal cooling stage is much less than the force present while an SMA element is being heated. In other words, conductive means, to be described in detail below, transfers the necessary power from either control contact 16*a* or 16*b* through conductive path element 24*a* or 24*b* and SMA element 26*a* or 26*b,* respectively, to ground contact element 18. For the below embodiments, SMA elements 26*a* and 26*b* will preferably have a diameter of between about 25 and 125 microns and can be supplied with 40 to 160 milliamps during operation.

Referring now to FIGS. 3A–3B through 6A–6B, the manufacturing process for fabricating the bistable switch according to the present invention will follow. In particular, FIGS. 3A, 4A, 5A and 6A illustrate the bottom surface of switch 10, and FIGS. 3B, 4B, 5B and 6B illustrate the respective side views of the same Figures.

Figure 3A:
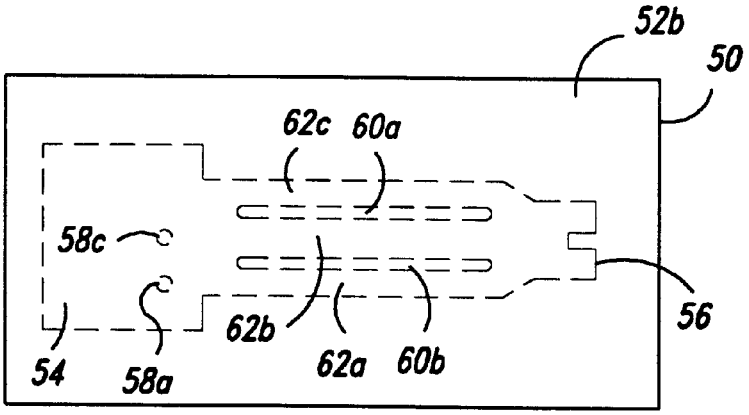
Figure 3B:
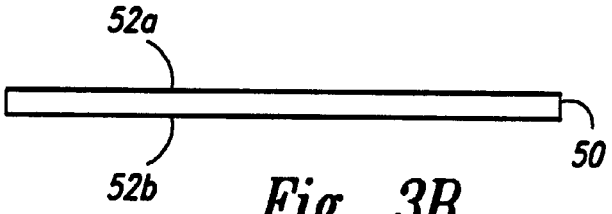

FIGS. 3A and 3B illustrate a stabilizing material 50 coated with a patterned photoresist layer 52. In this particular embodiment, stabilizing material 50 is a beryllium copper alloy that is manufactured in rolled sheets having a thickness between about 12 to 50 microns and a width of between about 300 to 1,200 microns. However, other materials may be used that provide the desired elastic or flexible properties and thickness. For example, materials selected from the group including polyresin, plastic, wood composites, silicon, silicon resin, and various alloy materials such as a stainless steel alloy may be used.

In a preferred micro-machining process, a conventional photolithographic technique is used to define the desired pattern onto the surface of stabilizing material 50 (pattern represented by dotted lines). In particular, patterned photoresist 52 defines a three beam structure having a tail portion 54 and a head portion 56, contact vias 58*a* and 58*c*, and two gaps 60*a* and 60*b* to define beams 62*a*, 62*b*, and 62*c*. A conventional etching technique removes stabilizing material 50 unprotected by pattern photoresist 52 to form the desired three beam structure 12 as illustrated in FIG. 4A.

Persons of ordinary skill in the relevant art will appreciate that the desired pattern can be formed by other conventional methods. For example, if the desired switch size is large enough to avoid micro-machining techniques, stabilizing material 50 could be patterned by a conventional punch or molding process.

Figure 4A:
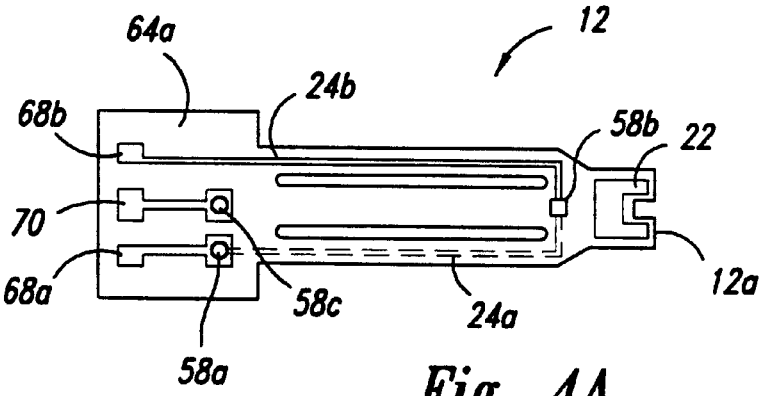
Figure 4B:
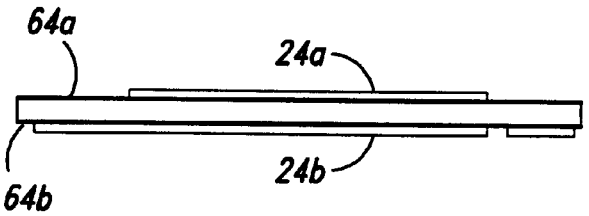

Next, as illustrated in FIGS. 4A and 4B, a nonconductive insulation layer 64 coats the top and bottom surface of structure 12. This electrical insulator is preferably a paralene layer. In alternative embodiments, insulation material 64 could be selected from the group including silicon dioxide, polyimide, wet oxide, and silicon nitride layer. These alternatives will provide a similar structure having similar operational characteristics. Persons of ordinary skill in the art will appreciate that insulation layer 64 may be eliminated if stabilizing material 50 is a nonconductive material.

On each side of coated structure 12, a conductive material, such as gold, is deposited and patterned to create a portion of the desired horseshoe-type path. More specifically, the top surface of coated structure 12 (see FIG. 1) provides an L-shaped conductive path 24*a* coupled between control via 58*a* and top contact pad. In addition, the same conductive material forms ground via 58*c*. On the opposite or bottom side of structure 12, as illustrated in FIG. 4A, coated structure 12 provides another L-shaped conductive path 24*b* coupled between control contact 68*b* and bottom contact pad 58*b*. In addition, the same material forms control contact 68*a*, ground contact 70 and bridge contact 22. Persons of ordinary skill in the relevant arts should appreciated that the conductive material for conductive paths 24*a* and 24*b*, control contacts 68*a* and 68*b*, ground contact 70, ground and control vias 58*a* and 58*c*, top and bottom contact pads 58*b*, and bridge contact 22 may be selected from the group of gold, copper, palladium-gold alloy, nickel, silver, aluminum, and many other conductive materials available in the art.

Figure 5A:
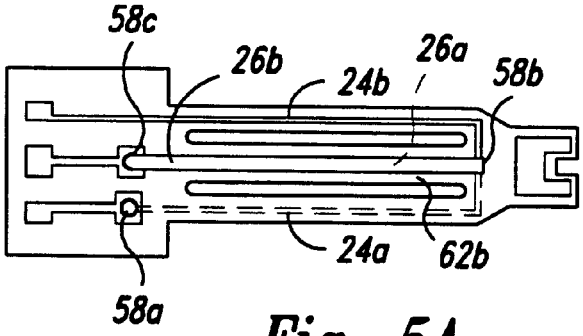
Figure 5B:
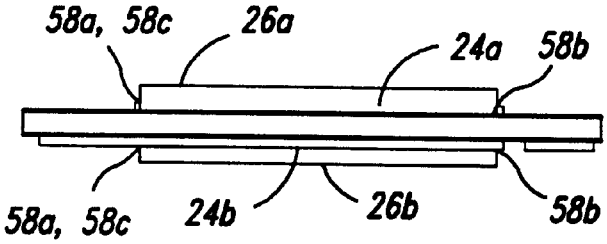

With reference to FIGS. 5A and 5B, an actuator element 26*a* and 26*b* securely couples to the top and bottom surfaces of arm 12 between each contact pad and ground via 58*c*. If desired, an adhesive material (not shown) can be used to couple actuator elements 26*a* and 26*b* to respective top and bottom arm surfaces. The adhesive material could be selected from the group including cement, epoxy, lock on chip tap, solder, embedding, polyimide, and mechanical attachment such as a clip or clamp. This connection positions each actuator element 26*a* and 26*b* over a central portion of the top and bottom surface of middle beam 62B to complete the conductive horseshoe-type path. Actuator elements 26*a* and 26*b* are preferably a nickel-titanium SMA provided in a sheet, ribbon, or wire form. For the above embodiments, SMA elements 26*a* and 26*b* will preferably have a diameter of between about 25 and 125 microns.

As disclosed earlier, SMA elements 26A and 26B extend or contract after current passing through the material reaches a preestablished phase transformation temperature. With this particular embodiment, the phase transformation process will typically occur by one of two methods. A first phase transformation technique reduces the bulk volume of the actuation material, and as a result, the length of the shape memory alloy will reduce, contracting stabilizing material 12. In a second phase transformation technique, SMA is stretched by a percentage not exceeding 8% before and/or after it is installed to stabilizing structure 12. Upon phase transformation, the length of SMA will reduce, going back to its original length before contracting the stabilizing material 12 layer even more, up to 8%. Depending on the requirements on the displacement of head portion 12*a*, contact force, number cycles, and manufacturing processes, the shape memory alloy may or may not be stretched.

The last steps of the desired process includes crimping and mounting the above structure. Without the crimping step, the above structure can be mounted to a desired substrate to form a reliable micro-machined bistable switch having a cantilever structure as illustrated in FIG. 1. In turn, the switch cannot continuously short the signal contacts unless power is active to generate the necessary current and transformation within the desired SMA element. Consequently, this final coining or crimping step will allow the active device to maintain a contact position, even after the power is deactivated. This coining or crimping, therefore, provides a snap action function to the arm that maintains the arm in a given position, except when one of the SMA elements flips the arm to the opposite position.

Figure 6A:
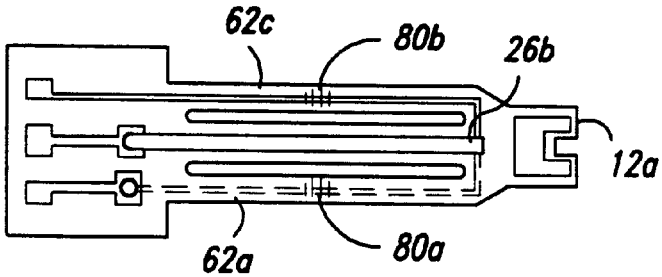
FIGS. 6A and 6B illustrate an alternative process step for manufacturing the bistable switch of FIG. 1 to include a crimped arm portion.
Figure 6B:
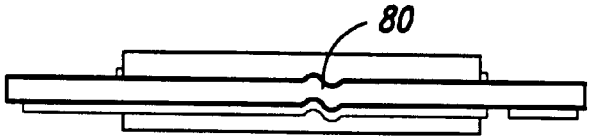

Referring to FIGS. 6A and 6B, the desired coined or crimped elements 80A and 80B are illustrated. This snap action structure may be formed using a conventional punch and dye method. More specifically, a central portion of left and right beams 62A and 62C are crimped to form a wave-type deformation or ungulation. To persons skilled in the relevant arts, this crimped area 80A and 80B will create a sustainable force when actuator element 26*a* or 26*b* transforms to move arm tip 12*a* up or down. In turn, crimped areas 80A and 80B will allow bridge contact 22 to maintain contact with or separation from signal contacts 20*a* and 20*b* even after the source coupled to switch 10 is deactivated. In other words, by forming crimps 80A and 80B, once arm 12 is positioned up or down, current must pass through the appropriate SMA element to bend arm 12 to the other position, down or up respectively. Otherwise, switch 10 will always be positioned up or down unless it is physically moved by the user.

Figure 7A:
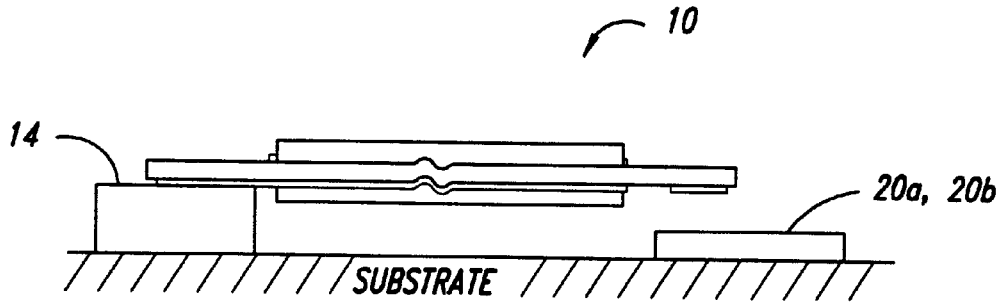
FIGS. 7A and 7B shows the bistable switch of FIG. 6A mounted and activated to illustrate a first and a second switch position.
Figure 7B:
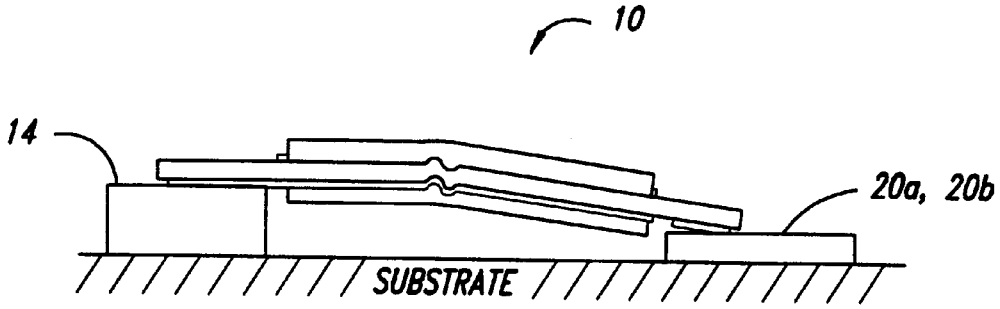

With or without a crimp element formed on first and third beams 62A and 62C, the resultant structure must be secured to substrate 14, as illustrated in FIGS. 7A and 7B or FIG. 1. In particular, cantilever switch 10 couples to substrate surface 14 by a conventional bonding method. In particular, solder or pressure slots of a printed circuit board are used to attach and secure power and ground contacts 16*a*, 16*b*, and 18 to substrate surface 14 of switch 10. Consequently, when actuating element 26*b* is heated by the bottom horseshoe-type conductive path, the resultant structure will bend downwards to couple bridge contact 22 with signal contacts 20*a* and 20*b*. in turn, when actuating material 26A is heated by the top horseshoe-type conductive path, the connection between bridge contact 22 and signal contacts 20*a* and 20*b* will be broken.

Figure 8:
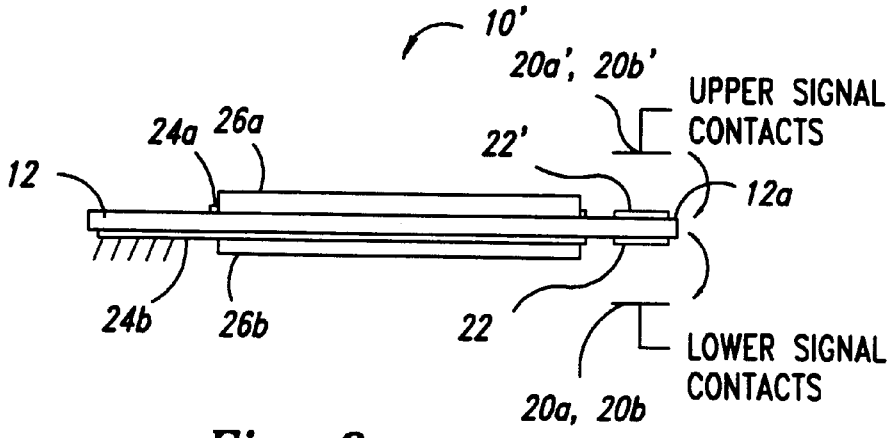
FIG. 8 illustrates an alternative embodiment of the bistable switch of FIG. 1 to include multiple bridge contacts.

Another embodiment of the present invention would include the placement of an additional bridging contact 22' on the top surface of tip 12*a* for shorting complementary signal contacts 20*a*', 20*b*' on a multiple layer substrate. With this example as illustrated in FIG. 8, if the top SMA element 26*a* is heated by an electrical current passing through the top horseshoe-type conductive path, the structure will move up to couple top bridging contact 22' with top signal contacts 20*a*' and 20*b*'. On the other hand, if actuator element 26B is heated by an electrical current passing through bottom horseshoe-type conductive path 24*b* and 26*b*, the structure will move down to couple bridging contact 22 with signal contacts 20*a* and 20*b*. With this particular embodiment, arm 12 is not crimped. Consequently, bridge contacts 22 or 22' will only be able to continually short signal contacts 20*a*, 20*b* or 20*a*', 20*b*' while the respective SMA 26*a* or 26*b* is heated to move tip 12*a* up or down. However, those skilled in the art will recognize that crimping could be used to maintain the arm 12 in contact with one or the other of contacts 20*a* and 20*b* or 20*a*' and 20*b*'.

Figure 9A:
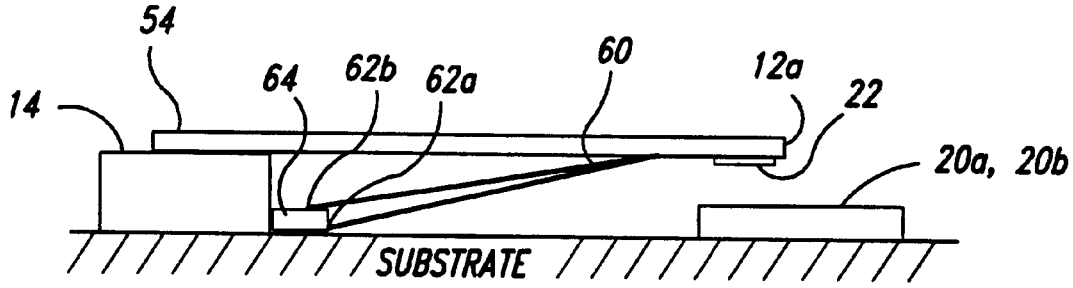
FIGS. 9A and 9B illustrate still another embodiment of the inventive bistable switch.
Figure 9B:
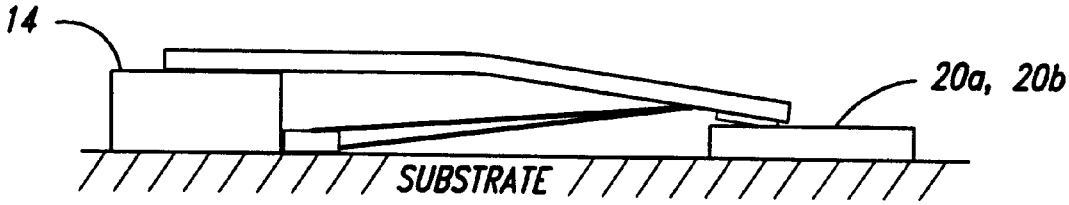

FIGS. 9A and 9B illustrate another embodiment of the above inventive switch. In this embodiment, sheet 50 is patterned and etched or punched to form the desired arm 12 as described above with reference to FIG. 3B, and bridge contact 22 is formed (as described above) on arm tip 12*a*. Next, a central portion of actuator element 60 is looped over or attached to arm 12 at a location adjacent to tip 12*a* and electrically separated from bridge contact 22. Lastly, tail portion 54 of arm 12 is attached to substrate surface 14 and ends 62*a* and 62*b* of actuator element 60 are extended in a horizontally opposed direction adjacent the length of arm 12 to connect with a power source 64 adjacent substrate surface 14. In other words, the conductive L-shaped path and contacts formerly located on arm 12 to provide the necessary circuit to activate SMA element (see FIG. 1) has been moved to a location off of switch arm 12, to provide power source 64.

Referring now to FIG. 9B, during operation, a current supplied to SMA 60 by source 62 contracts SMA 60 to move arm 12 down and short signal contacts 20*a* and 20*b* with bridge contact 22. As described in the above disclosure, with power source 62 deactivated, SMA 60 will return to a position that will separate bridge contact 22 from signal contact 20*a* and 20*b*. The skilled artisan will appreciate that another SMA (not shown) may be attached in a similar way to arm 12, but on an opposite side to SMA 60, and supplied current by a similar power source. In turn arm 12 can be crimped to form a device that will function as described above with reference to FIGS. 7A and 7B, and arm 12 can be patterned with or without multiple parallel beams. With this particular embodiment, a single coining or a complete surface crimp may be used if there are no beams on arm 12 and an additional SMA element is attached to or wrapped around the other side of arm 12.

With respect to the above embodiments, it will be appreciated by persons of ordinary skill in the relevant arts that arm 12 can be patterned to form a structure having as many beams as necessary to hold any desired SMA element(s). In turn arm 12 could be patterned to form only a rectangular structure having no beams. On a similar note, the thickness and number of SMA elements 26*a* and 26*b* can increase or decrease to accommodate the desired arm structure and force necessary to move the same when heated. Additionally, the number of crimps formed on flexible arm 12 will depend on the shape and functional characteristics of the resultant switch.

In summary, this invention provide a relatively simple and inexpensive way to produce micro-switches and relays. This new and innovative micro-machine way of fabricating micro-switch and relays will enable a user to build systems that can carry very high voltage, current, and frequency signals. Additionally, this inventive process can conceptually be designed to be compatible with standard silicon processing and allow mass production of the device at very reasonable cost. Consequently, the inventive structure provides a miniature bistable snap action electro-mechanical switch that can be activated by a shape memory alloy which possess a unique capability for increase speed actuation and forces relative to any prior art switching mechanism. In addition, because of the advances in micro-machining, this structure can be produced to have a length similar to between about 500–3,000 microns, a width between about 200–1,200 and between about 25–35 microns thick, which is smaller than any competing bistable switches on the market today. A skilled artisan will appreciate that these dimensions may change to obtain the desired size and functional characteristics for the inventive switch.

Other variations in design still coming within the inventive concept claimed herein will be apparent to those skilled in the art. For example, the illustrative embodiments described herein employ SMA elements 26*a* and 26*b* as part of the conductive path for heating the SMA elements to accomplish the same end. For example, the SMA elements could be coupled to a separate electrically conductive element, or they could be coupled to an entirely different sort of heating element (e.g., non-electrical).

Illustrative embodiments of the invention are described above. In the interest of clarity, not all features of an actual implementation are described in the specification. It will be of course appreciated that in the development of any such actual embodiment, numerous implementation-specific decisions must be made to achieve a developer's specific goals, such as compliance with system-related and business-related constraints, which will vary from one implementation to another. Moreover, it will appreciated that, although such a development effort might be complex and time-consuming, it would nonetheless be a routine undertaking for those of ordinary skills in the art having the benefit of this disclosure.

What is claimed is:

1. A bistable switch, comprising:

a substrate having at least one power source;

a flexible sheet having a first distal end attached to said substrate, said flexible sheet further including a crimp positioned at a central area of said flexible sheet;

a bridge contact formed at a second and opposite distal end of said flexible sheet; and at least one heat activated element connected to a first surface of said flexible sheet between said second distal end and said power source, wherein current from the power source passing through said heat activated element indirectly bends said flexible sheet and shorts said bridge contact on said substrate with a first sustainable force.

2. The bistable switch of claim 1, wherein said power source supplies a current of between about 40 and 160 milliamps.

3. The bistable switch of claim 1, wherein said crimp allows said first sustainable force to be maintained even after said power source is deactivated.

4. The bistable switch of claim 1, wherein said flexible sheet is between about 12 and 50 microns thick.

5. The bistable switch of claim 1, further including a second heat activated element connected to a second and opposite surface of said flexible sheet between said second distal end and a second power source, wherein current from the power source passing through said second heat activated element indirectly bends said flexible sheet with a second sustainable force.

6. The bistable switch of claim 5, wherein said crimp allows said first sustainable force to be maintained even after said power source is deactivated or until said second heat activated element is activated.

* * * * *